United States Patent [19]

Moffitt

[11] Patent Number: 5,058,685

[45] Date of Patent: Oct. 22, 1991

[54] DOZER BLADE MOUNTING APPARATUS

[75] Inventor: John M. Moffitt, Wichita, Kans.

[73] Assignee: J. I. Case Company, Racine, Wis.

[21] Appl. No.: 554,243

[22] Filed: Jul. 17, 1990

[51] Int. Cl.[5] ..... E02F 3/76

[52] U.S. Cl. ..... 172/820; 172/830; 37/234

[58] Field of Search ..... 172/818, 819, 820, 821, 172/822, 830, 831; 37/231, 234, 236

[56] References Cited

U.S. PATENT DOCUMENTS

| | | | |
|---|---|---|---|
| 2,634,519 | 4/1953 | Merz | 172/821 |
| 3,529,678 | 9/1970 | Teasdale | 172/821 |
| 3,759,110 | 9/1973 | Davis | 74/99 |
| 4,081,036 | 3/1978 | Yokoyama | 172/804 |
| 4,120,366 | 10/1978 | Nissen et al. | 172/805 |
| 4,244,429 | 1/1981 | Nissen | 172/804 |
| 4,253,529 | 3/1981 | Nissen | 172/831 |
| 4,337,837 | 7/1982 | Nissen | 172/822 |

FOREIGN PATENT DOCUMENTS

| | | | |
|---|---|---|---|
| 449682 | 4/1968 | Switzerland | 37/234 |
| 315748 | 12/1971 | U.S.S.R. | 172/818 |
| 374418 | 4/1973 | U.S.S.R. | 172/820 |
| 973722 | 11/1982 | U.S.S.R. | 172/819 |

*Primary Examiner*—David H. Corbin
*Assistant Examiner*—Jeffrey L. Thompson
*Attorney, Agent, or Firm*—Dressler, Goldsmith, Shore, Sutker & Milnamow, Ltd.

[57] ABSTRACT

An apparatus for mounting a dozer blade for vertical and angular movement relative to a frame of a wheeled implement. The mounting apparatus a mounting mechanism which allows the dozer blade to be mounted close to the wheels to either end of the implement and which permits angular movement of the blade about a generally vertical axis and vertical movement of the dozer blade about a generally horizontal axis. The mounting apparatus further includes a linearly distendable driver which extends laterally across the frame of the implement and a linkage mechanism which improves angling moments and maximizes the driving force imparted to the blade upon extension of the driver. The linearly distendable driver and linkage mechanism operate in combination and in a closely confined area adjacent to the implement frame for effecting extended angular movement of the dozer blade.

10 Claims, 4 Drawing Sheets

22
20
12
10
82
40
46
84
30
18
28
26
24
14

12
26
36
82
86
44
40
94
32
90
80
108
104
22
96
92
84
50
76
24
88
98
78
102
72
106
54
42
38
100
110
56
30
34
68
28
120
66
24
74
52
70

FIG. 5
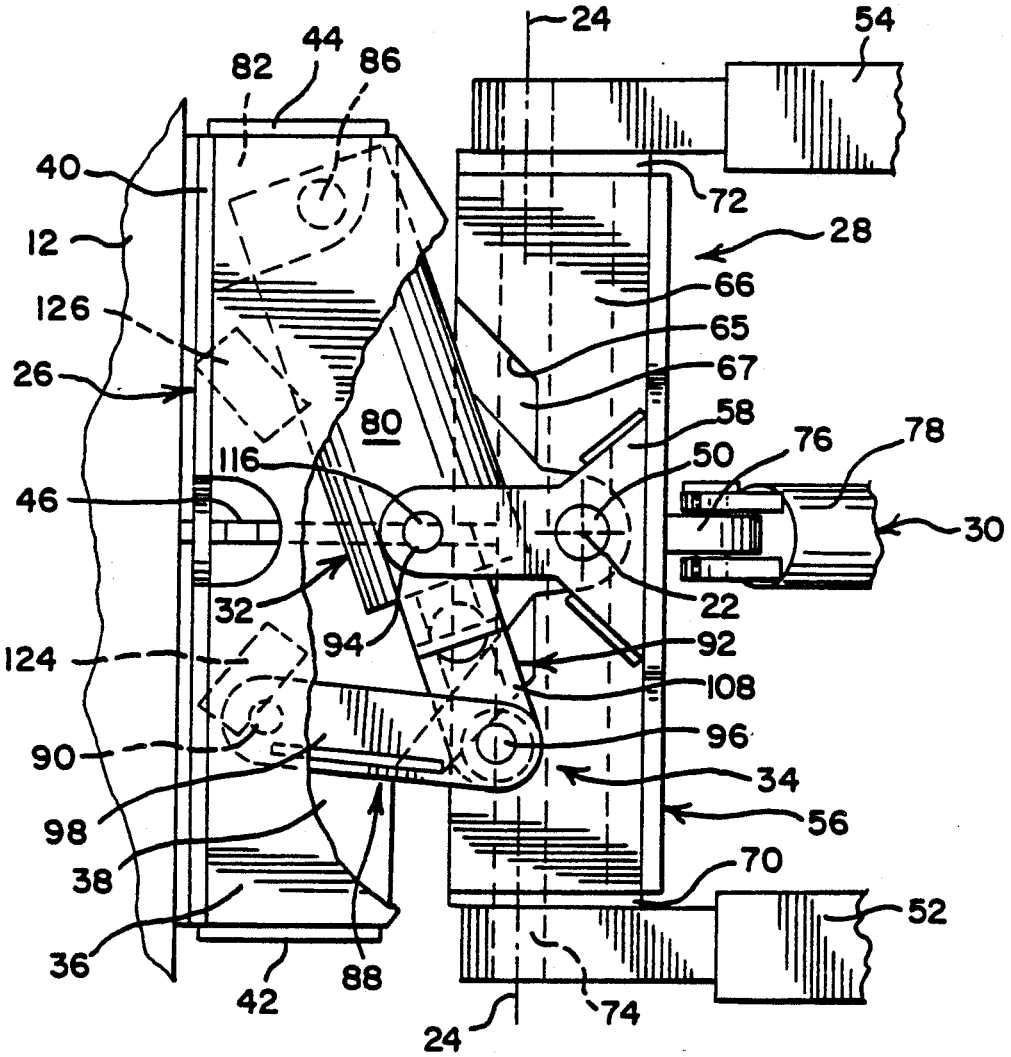
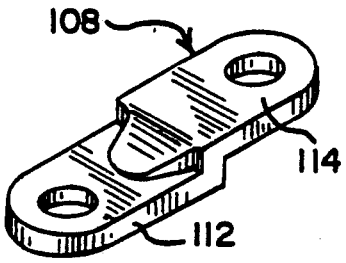
FIG. 6

DOZER BLADE MOUNTING APPARATUS

FIELD OF THE INVENTION

The present invention generally relates to a blade mounting assembly and, more particularly, to an apparatus for mounting a dozer blade on a frame of an implement.

BACKGROUND OF THE INVENTION

The prior art includes a number of blade mounting assemblies for bull dozer blades. These blade mounting assemblies are not satisfactory for relatively small tractors or dozer implements wherein it is preferable to mount a dozer blade close to an implement frame for stability and ease of handling.

Besides positioning the dozer blade close to the implement frame, a blade mounting apparatus on a small implement should mount the blade in a manner permitting varied motions, i.e., raising, lowering and angling of the blade with respect to predetermined reference planes. The blade mounting apparatus should allow the dozer blade to angularly move at least 35° in opposite directions about a vertical axis while maximizing blade offset (the lateral distance the blade laterally extends beyond the wheels) in a fully angled position.

J. I. Case Company manufactures and sells wheeled trenchers with a dozer blade attached thereto. The trencher dozer blade is most commonly used in backfilling operations. A conventional blade mounting apparatus on a wheeled trencher includes a pivotally movable blade mounting frame with the dozer blade connected to a forward end thereof. Angular movement of the blade mounting frame is controlled by a linearly distendable driver which extends in a fore-and-aft direction relative to the implement frame.

The driver is typically in the form of a hydraulic cylinder. The cylinder end of the driver is connected to the implement frame and a movable piston end of the driver is connected to the blade mounting frame to one side of a pivot connection about which the mounting frame angularly moves. As will be appreciated, the fore-and-aft orientation of the cylinder tends to elongate the mounting frame design and moves the blade away from the implement frame. Moreover, arranging a linearly distendable driver generally parallel to the implement frame for angling the dozer blade detracts from the driving force imparted to the blade upon extension of the driver.

Thus, a need and a desire remains for a blade mounting apparatus which allows for extended angling and vertical movement of the blade while minimizing the distance between the dozer blade and frame of the implement.

SUMMARY OF THE INVENTION

In view of the above, and in accordance with the present invention, there is provided an apparatus for mounting a dozer blade for vertical and angular movement relative to a frame of an implement. The dozer blade mounting apparatus includes a linearly distendable driver which extends laterally across the frame of the implement and a linkage mechanism which improves angling moments and maximizes the driving force imparted to the blade upon extension of the driver. The linearly distendable driver and linkage mechanism operate in combination and in a closely confined area adjacent to the implement frame for effecting extended angular movement of the dozer blade with respect to a generally vertical pivot axis.

The frame of the implement extends in a fore-and-aft direction and is supported for movement over a ground surface. In the illustrated embodiment, the frame is supported for movement on at least one pair of wheels which rotate about a common axis.

The dozer blade mounting apparatus of the present invention includes a mounting assembly which connects the dozer blade to the implement frame to permit angular movement of the dozer blade about a fixed generally vertical axis and furthermore permits vertical movement of the dozer blade about a generally horizontal axis. A blade positioning motor is connected to the mounting assembly for vertically positioning the dozer blade about the generally horizontal axis.

The linkage mechanism of the mounting apparatus influences angular movement of the dozer blade about the vertical axis and includes a first linkage connected to the mounting assembly at a first connection and second linkage connected to the frame of the implement at a second connection. The linearly distendable driver is preferably connected to the implement frame and the linkages at a third connection whereat the linkages are connected to each other.

In the illustrated embodiment, the linkage mechanism is in the form of a toggle linkage assembly coupled at opposite ends to the mounting assembly and the implement frame. The toggle linkage assembly is articulately connected to the mounting assembly at a location rearwardly of the generally vertical axis about which the dozer blade angularly moves to reduce the distance between the blade and the frame of the implement.

The toggle linkage is connected intermediate its ends to the linearly distendable driver for improving angular movements of the dozer blade and enhancing performance of the driver in imparting angular movement to the dozer blade. Preferably, the links used in forming the toggle linkage assembly have a vertically stepped configuration for minimizing the vertical height of the mounting assembly and thereby improving ground clearance for the implement. As will be appreciated, the pivotal connections and link lengths of the linkage assemblies are chosen to maximize the drive force while maintaining the driver and linkages within the confines defined by the mounting apparatus.

In the illustrated embodiment, the mounting assembly includes a mounting frame and a C-frame connected to the mounting frame. The mounting frame is configured to permit attachment of the mounting assembly to either end of the implement frame and is provided with a pivot pin defining the generally vertical axis about which the dozer blade angularly moves. The C-frame extends forwardly from and is connected to the mounting frame for angular movement about the pivot pin.

The C-frame defines a generally horizontal axis which allows vertical movement of the dozer blade connected thereto at a distal end thereof. The C-frame includes laterally spaced side members which extend away from the implement frame for positioning and securing the dozer blade to the mounting frame. To minimize the distance between the dozer blade and the common axis of the wheels on the implement, the mounting assembly is configured to locate the generally vertical axis about which the dozer blade angularly moves further from the implement frame than is the generally horizontal axis about which the dozer blade vertically moves.

Connecting a linearly distendable driver which is arranged across an implement frame to a dozer blade mounting assembly through a linkage mechanism offers many beneficial results. The lateral disposition of the driver maintains the blade in close proximity to the frame to facilitate control over the ground line of the dozer blade and thereby enhance productivity of the implement when the blade is used. Connecting the driver to the blade mounting assembly through a linkage mechanism enables the amount of angular blade movement to increase from about 35° to about 40° (in both the right and left directions). Moreover, the use of a toggle linkage mechanism improves angling moments and allows better utilization of the cylinder force developed by the driver during operation of the blade.

Numerous other features and advantages of the present invention will become readily apparent from the following detailed description, appended drawings, and accompanying claims.

BRIEF DESCRIPTION OF THE DRAWINGS

FIG. 5 is an enlarged fragmentary plan view, partially broken away, of the dozer blade mounting apparatus;

FIG. 6 is a perspective view of a link forming part of the dozer blade mounting apparatus.

DETAILED DESCRIPTION OF THE PRESENT INVENTION

Figure 1:
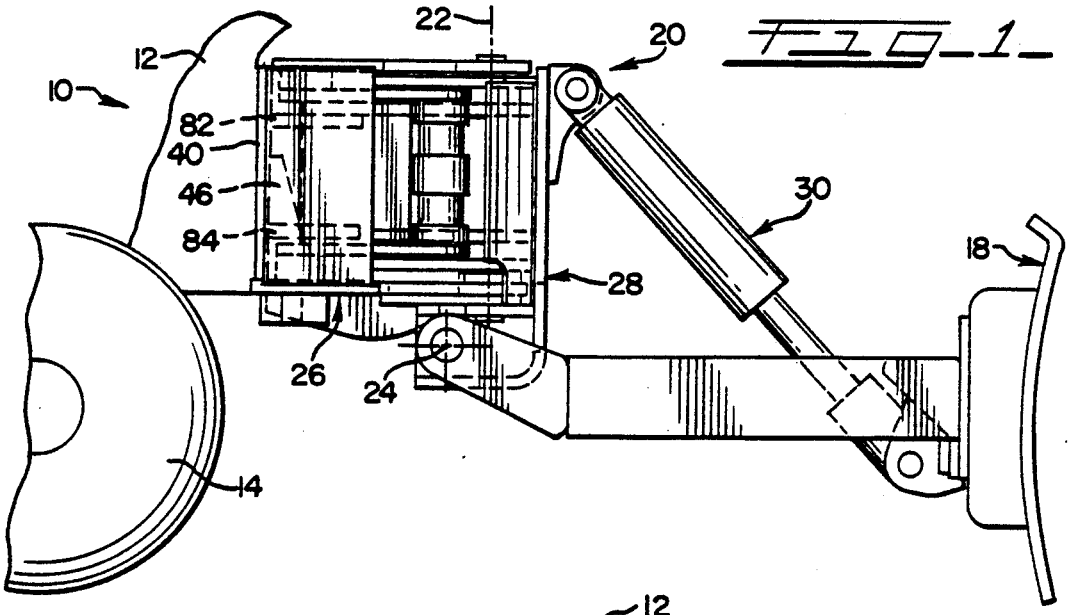
FIG. 1 is a side elevational view of a wheeled implement with a dozer blade mounting apparatus supported thereon.

While the present invention is susceptible of embodiment in various forms, there is shown in the drawings, and will hereinafter be described, a preferred embodiment of the invention with the understanding that the present disclosure is to be considered as an exemplification of the invention and is not intended to limit the invention to the specific embodiment illustrated.

Referring now to the drawings, wherein like reference numerals indicate like parts throughout the several views, there is shown a self-propelled off-highway vehicle or implement which is depicted only fragmentarily and is seen as represented in its entirety in FIG. 1 by reference numeral 10. The implement 10 has a fore-and-aft extending frame 12 which is supported for movement over a ground surface. In the illustrated embodiment, a pair of ground engaging wheels 14, which rotate about a common axis, support the implement 10 for movement over the ground surface.

Figure 2:
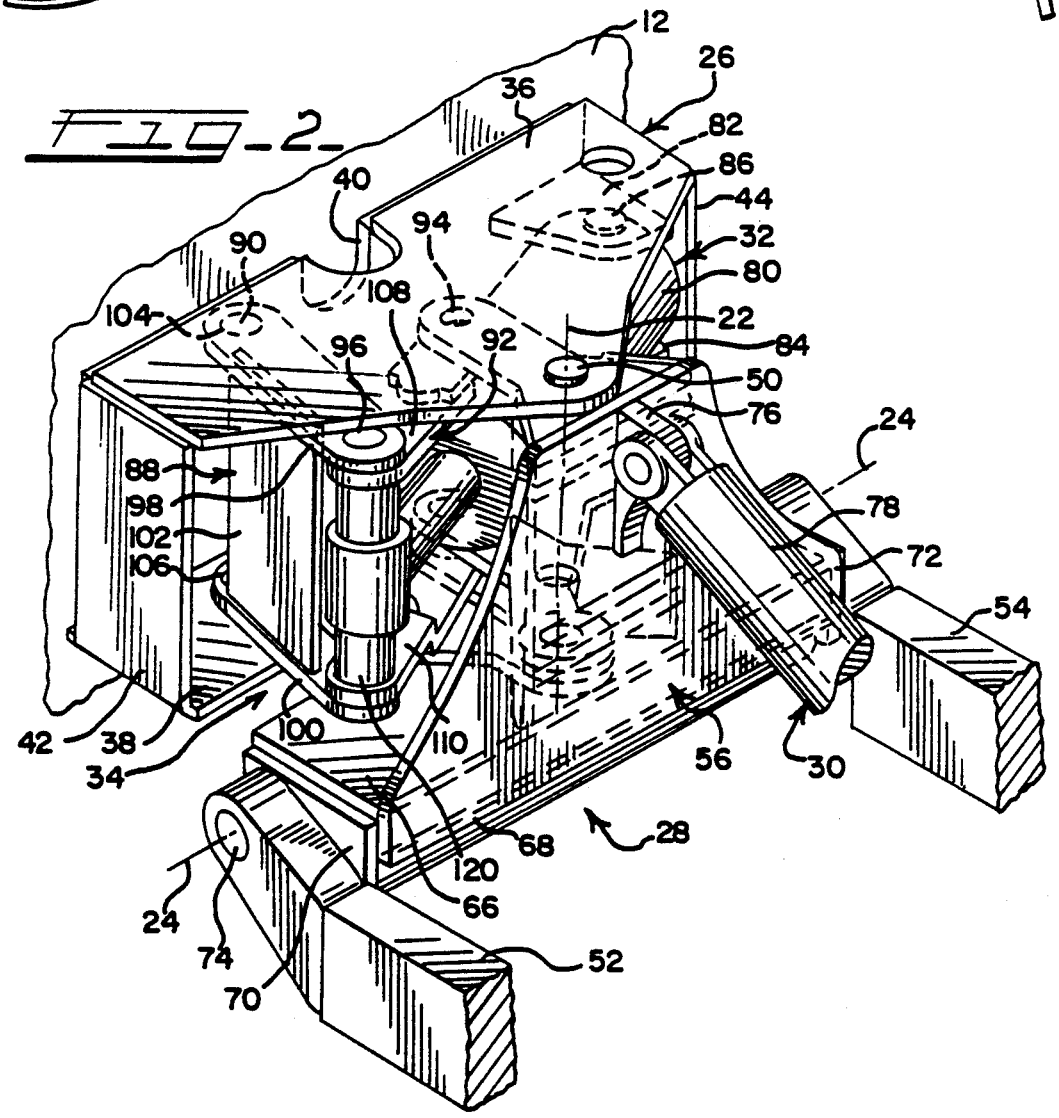
FIG. 2 is a fragmentary perspective view of a dozer blade mounting apparatus according to the present invention.

A dozer blade 18 is supported at and connected to one end of the implement frame 12 by a dozer blade mounting apparatus 20. As illustrated in FIGS. 1 and 2, and as will be discussed in detail hereinafter, the dozer blade mounting apparatus 20 of the present invention allows for movement of the dozer blade 18 about a generally vertical axis 22 to angle the dozer blade 18 relative to the implement 10 and about a generally horizontal axis 24 to provide a lift component to the dozer blade 18.

According to one aspect of this invention, and to minimize the required space between the implement frame 12 and dozer blade 18, the generally vertical axis 22 about which the dozer blade angularly moves is disposed a further distance away from the implement frame 12 than is the horizontal axis 24 about which the dozer blade 18 vertically moves.

As illustrated, the dozer blade mounting apparatus 20 includes a mounting frame 26 and a C-frame 28 pivotally connected to the mounting frame 26. The blade mounting apparatus 20 further includes a dozer blade positioning apparatus 30 for positioning the blade 18 through vertical movement relative to a ground line or surface and about the horizontal axis 24. The blade mounting apparatus 20 further includes a linearly distendable driver 32 carried by the mounting frame 26 for imparting angular movement to the dozer blade 18 about the generally vertical axis 22. Driver 32 is connected to the C-frame 28 through a linkage assembly 34 which influences the angular movement of the dozer blade about the generally vertical axis 22.

As illustrated in FIG. 2, the mounting frame 26 includes upper and lower plates 36 and 38, respectively, which are generally parallel and vertically spaced from each other and extend away from the implement frame 12. The upper and lower plates 36 and 38, respectively, are interconnected to each other and extend in a cantilevered fashion away from a vertical mounting plate 40. The mounting plate 40 preferably extends across the entire lateral dimension of the mounting frame 26. The mounting frame 26 further includes side plates 42 and 44 which are interconnected to the upper and lower plates 36 and 38 to add strength and rigidity to the mounting frame 26.

A centrally disposed gusset plate 46 (FIG. 1) is connected to and extends from the mounting plate 40 beneath the lower plate 38 to add further support and rigidity to the mounting frame 26. Toward the distal end of the mounting frame 26, the upper and lower plates 36 and 38, respectively, accommodate a vertically elongated pivot pin 50 which defines the vertical axis 22 about which the dozer blade 18 angularly moves.

Figure 3:
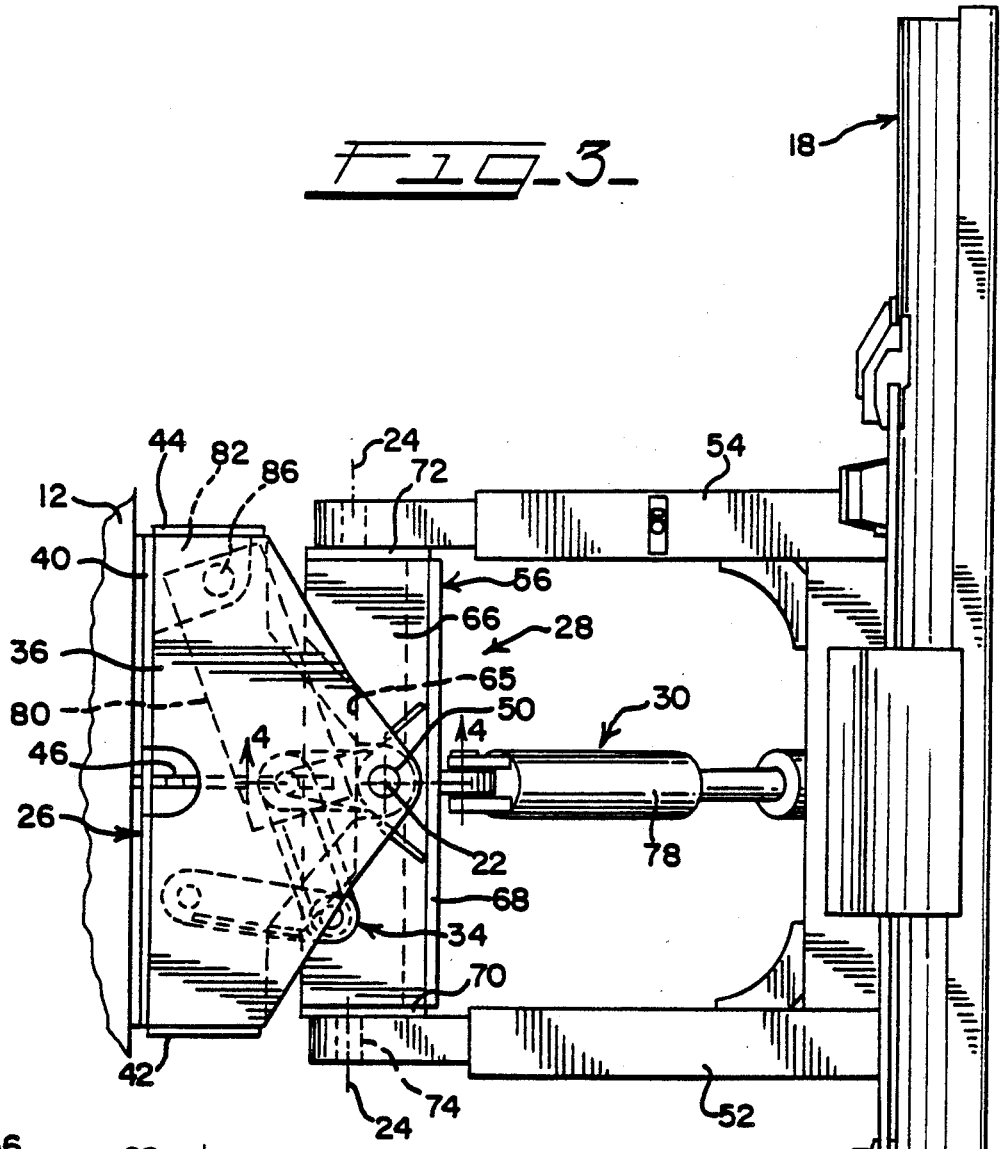
FIG. 3 is a plan view of the dozer blade mounting apparatus supported on the implement.

The C-frame 28 positions and secures the dozer blade 18 to the mounting frame 26 and, thereby, to the implement frame 12. The C-frame 28 is pivotally secured to the mounting frame 26 as with pivot pin 50 for angular movement about the fixed vertical axis 22. As illustrated in FIG. 3, the C-frame 28 defines the horizontal axis 24 about which the dozer blade 18 vertically moves and includes laterally spaced side members 52 and 54 which are joined to each other by an intermediate member 56. An inner end of each side member 52, 54 is connected to the intermediate member 56 for pivotal movement about the generally horizontal axis 24. The side members 52 and 54 of the C-frame 28 extend away from the implement frame and have the dozer blade 18 connected toward their distal ends.

The intermediate member 56 of C-frame 28 is configured to cooperate with the upper and lower plates 36 and 38, respectively, on the mounting frame so as to permit free angular movement of the C-frame 28 about the pivot pin 50 and inhibit vertical movement of the C-frame 28 relative to the mounting frame 26.

Figure 4:
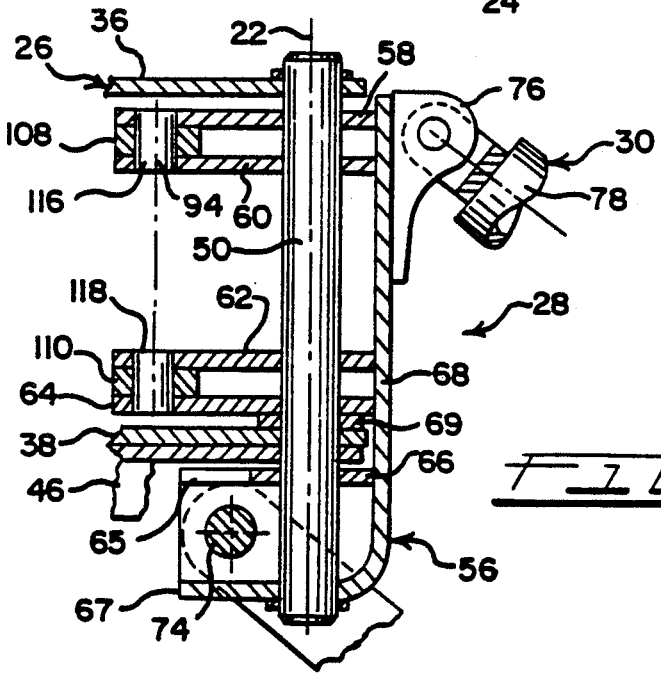
FIG. 4 is a side sectional view taken along line 4—4 of FIG. 3.

Turning now to FIG. 4, in the illustrated embodiment, the intermediate member 56 of C-frame 28 includes a series of parallel and vertically spaced arms 58, 60, 62, 64, 66 and 67. As illustrated, pivot pin 50 extends through each of the arms 58 through 67, inclusive, and is inhibited from endwise movement relative thereto by retainer rings or other suitable devices. Each of the arms 58 through 67, inclusive, on the intermediate member 56 of the C-frame 28 are connected to and extend from one side of a vertical plate 68.

In the illustrated embodiment, arms 58 and 60 extend parallel to and beneath upper plate 36 of mounting frame 26. Arms 62 and 64 extend parallel to and are supported by lower plate 38 of mounting frame 26. A bushing 69 is preferably provided between arm 64 of intermediate member 56 and lower plate 38 of mounting frame 26 to minimize frictional contact when the C-frame 28 is angularly moved relative to the main frame. Arms 66 and 67 of the intermediate member 56 extend substantially the lateral width of the C-frame 28 and generally parallel to and beneath the lower plate 38 of mounting frame 26. A cut-out 65 is defined by the central region of arm 66 to provide clearance for the gusset plate 46 on the mounting frame 26.

At its lower end, the vertical plate 68 substantially spans the lateral distance separating side members 52 and 54. As seen in FIG. 2, the lateral span of plate 68 narrows in an upward direction. As seen in FIGS. 2, 3 and 5, vertical end caps 70 and 72 interconnect arms 66 and 67 of the intermediate member 56. The end caps 70 and 72 add strength and rigidity to the arms 66 and 67 to enable them to maintain their parallel relationship to lower plate 38 of the mounting frame 26. A horizontal shaft 74 extends outwardly from opposite sides of the end caps 70 and 72 and defines the horizontal axis 24 about which the mounting blade vertically moves.

A mounting ear 76 is welded or otherwise fixedly secured to and extends from an opposite side of vertical plate 68. The mounting ear 76 secures one end of the positioning apparatus 30 to and for angular movement with the C-frame 28. The opposite end of the positioning apparatus 30 is suitably secured to blade 18. In the preferred embodiment, the positioning apparatus 30 is a fluid operated ram or hydraulic cylinder 78 which is independently extended and retracted to suitably position the dozer blade 18 relative to the ground line or ground surface.

The C-frame 28 is angularly moved about the pivot pin 50 by the linearly distendable driver 32. According to another aspect of this invention, driver 32 is a fluid operated ram or hydraulic cylinder 80 which is arranged in a unique fashion to minimize the space between the implement frame 12 and the dozer blade 18. As illustrated in FIG. 5, the cylinder 80 laterally extends across the implement frame and is substantially enclosed and protected in the confined space between mounting frame 26 and C-frame 28.

As illustrated more clearly in FIG. 2, the mounting frame 26 has short extensions 82 and 84 to one side thereof. In the illustrated embodiment extensions 82 and 84 are secured, as by welding or the like, to mounting plate 40 and side plate 44 of mounting frame 26. The extensions 82 and 84 are configured to rotatably accommodate trunnion pins 86 located on the cylinder portion of driver 32.

Another salient aspect of the present invention is that an opposite end of driver 32 is connected to the C-frame 28 through linkage assembly 34 which influences angular movement of the dozer blade 18 and maximizes the driving force of driver 32. In the preferred embodiment, linkage assembly 34 is configured as a toggle linkage mechanism which is coupled at opposite ends to the implement frame 12, through mounting frame 26, and to C-frame 28.

As seen in FIG. 5, linkage assembly 34 preferably includes a first linkage 88 connected to the mounting frame 26 at a first connection 90 and a second linkage 92 connected to the C-frame 28 at a second connection 94. The linkages 88 and 92 are connected to each other and to the driving end of the linearly distendable driver 32 at a third connection 96.

As illustrated in FIG. 2, linkage 88 includes first and second or upper and lower vertically spaced and aligned links 98 and 100 which are interconnected by a plate 102. Links 98 and 100 are substantially identical to each other and are pivotally secured to the mounting frame 26 by vertically aligned pins 104 and 106 which define the first pivotal connection 90.

As further illustrated in FIGS. 2 and 4, linkage 92 includes first and second or upper and lower vertically spaced and aligned links 108 and 110, respectively. Links 108 and 110 are substantially identical to each other and, thus, a detailed description of link 108 will suffice for an understanding of both links. As clearly illustrated in FIG. 6, each link has a vertically stepped configuration including a first section 112 and a second section 114 which are rigidly connected to each other in vertically offset planes. As illustrated in FIG. 2, the first and second sections on links 108 and 110 are generally opposite to each other to enhance clearance about the cylinder 80 of driver 32 without having to increase the vertical height of the mounting apparatus 20.

Returning to FIG. 4, links 108 and 110 are pivotally secured toward the distal end of arms 58, 60 and 62, 64, respectively, of the intermediate member 56 of C-frame 28. In the illustrated embodiment, link 108 is articulately connected between the arms 58 and 60 of intermediate member 56 by a pin 116. Link 110 is articulately connected between the arms 62 and 64 of intermediate member 56 by a pin 118 which is vertically aligned with pin 116. Pins 116 and 118 define the second pivotal connection 94. Notably, and to minimize the distance between the implement frame 12 and the dozer blade 18, the second pivotal connection 94, whereat linkage 92 is connected to the C-frame, is located rearward of the generally vertical axis 22 about which the dozer blade angularly moves.

The upper links 98, 108 and lower links 100, 110 of linkages 88 and 92, respectively, are connected to each other by a vertical pin 120 defining the third connection 96. Intermediate its ends, pin 120 is connected to the movable end of driver 32.

Figure 8:
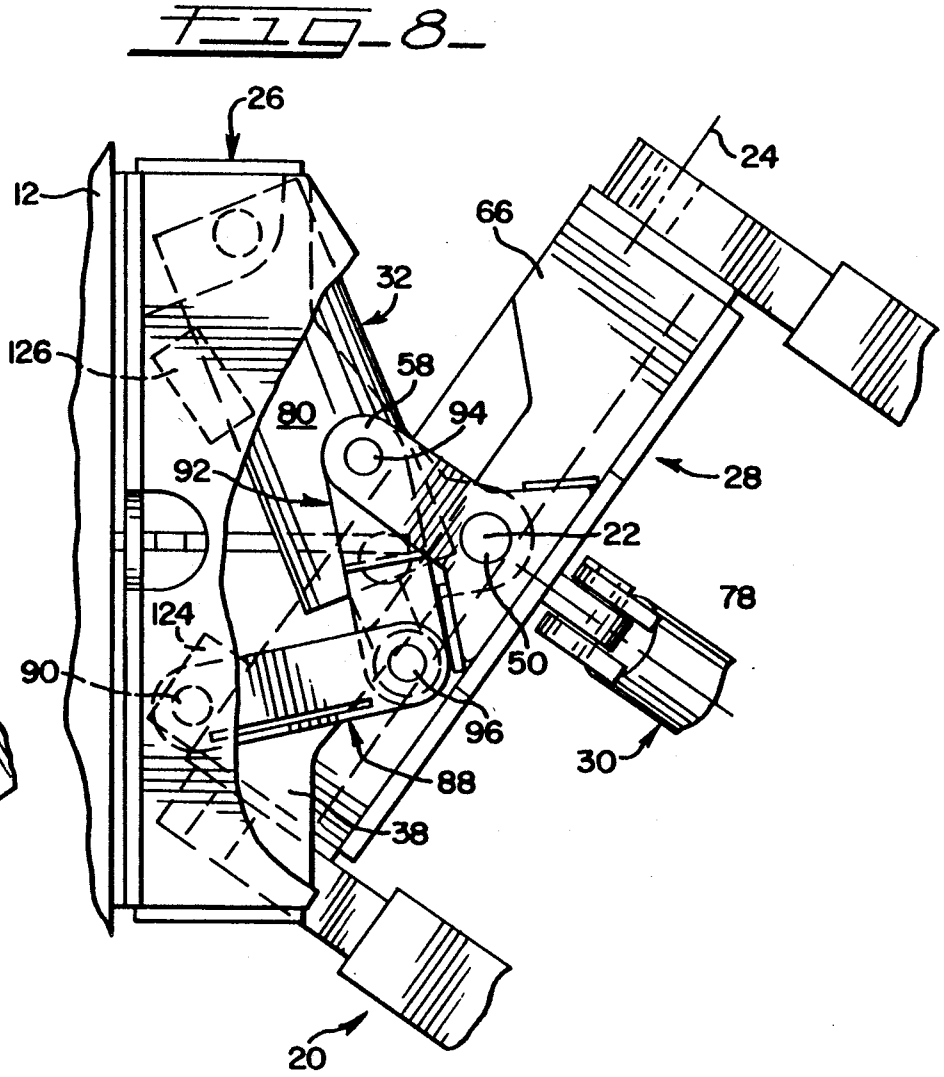
FIGS. 7 and 8 are enlarged fragmentary plan views similar to FIG. 5 showing the dozer blade mounting apparatus in opposite angular positions.
Figure 7:
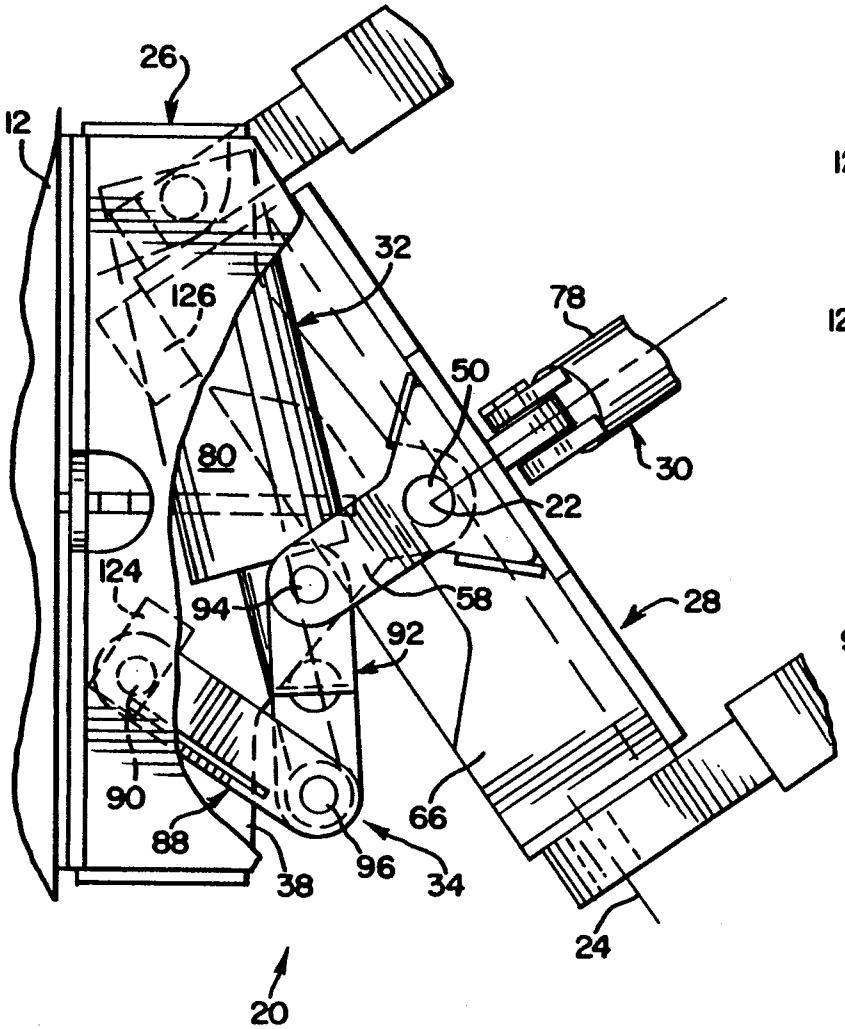

As illustrated in FIGS. 7 and 8, the blade mounting assembly or apparatus 20 further includes suitable limit stops 124 and 126 for limiting movement of the dozer blade in opposite angular directions about the generally vertical axis 22. As illustrated, stops 124 and 126 are fixedly secured to and extend upwardly from lower plate 38 on mounting frame 26 to permit the C-frame 28 and thereby the dozer blade to angularly move about 40° in opposite angular directions about the generally vertical axis 22. The stops 124 and 126 are positioned on the mounting frame 26 to interfere with or limit movement of arm 60 on C-frame 28 therepast. As will be appreciated, the limit stops 124 and 126 are positioned to prevent the dozer blade from being angled to such an extent as to interfere or strike the wheels of the implement.

The operation of the dozer blade mounting apparatus 20 is believed to be understood from the above description but will be briefly summarized at this point. The mounting frame 26 is configured such that the dozer blade mounting apparatus 20 can be attached to either end of the implement frame 12 to match the job.

Angular movement of the dozer blade about the generally vertical axis 22 is accomplished through actuation of the fluid operated linearly distendable driver 32. Arranging the driver 32 laterally across the implement frame 12 and within the confined space between the mounting frame 26 and C-frame 28 will minimize the distance between the implement frame 12 and the dozer blade 18. As will be understood, minimizing the distance between implement frame 12 and dozer blade 18 will improve blade stability relative to the ground line and thereby facilitate backfilling operations. Minimizing the distance between implement frame 12 and the dozer blade furthermore enhances the compactness and, therefore, maneuverability of the implement.

Powered vertical movement of the dozer blade about the generally horizontal axis 24 is effected through actuation of the cylinder 78 defining the dozer blade positioning apparatus 30. By maintaining the cylinder 78 for movement with the C-frame 28, the dozer blade can be vertically positioned throughout its angular movement. Moreover, arranging the generally vertical axis 22 about which the dozer blade angularly moves further from the implement frame 12 than is the generally horizontal axis 24 about which the blade vertically moves furthermore economizes on the space separating the dozer blade from the implement frame 12.

As illustrated in FIGS. 7 and 8, the driver 32 is connected to the C-frame 28 through the toggle linkage assembly 34 which influences angular movement of the dozer blade and maximizes utilization of the force of driver 32. As will be appreciated, the pivot connections 90, 94 and 96 can be located and the length of the links defining the first and second linkages 88 and 92, respectively, can be selectively chosen to remain within the confines of the mounting assembly while maximizing the effectiveness of the driver 32 and thereby improving angle moments.

From an understanding of the above, it can be appreciated that the present invention offers a dozer blade mounting apparatus which allows angular and vertical movement of a dozer blade through use of two drivers while maintaining an extreme compact structure which provides the necessary rigidity for the overall arrangement. Furthermore, the ability to mount the blade mounting apparatus to either end of the implement as a complete assemblage minimizes the time required to attach or remove the mounting apparatus from the implement and thereby maximize implement usage.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An apparatus for mounting a dozer blade on a frame of an implement for angular movement relative to said frame, said mounting apparatus comprising:

mounting means for connecting said dozer blade to said implement frame in a manner permitting angular movement of said dozer blade about a fixed generally vertical axis;

linkage means disposed to a first side of said mounting apparatus for influencing angular movement of said dozer blade about said vertical axis, said linkage means comprising a first linkage pivotally connected to said implement frame at a first pivotal connection and a second linkage pivotally connected at a second pivotal connection to an arm connected to rotate about said vertical axis as said blade angularly moves; and linearly distenable driver means positively driven in opposite directions and having a first end connected to said implement frame toward a second side of said mounting apparatus and a second end joined to said linkages at a third connection whereat the linkages are connected to each other for selectively imparting angular movement to said dozer blade, said driver means extending between said ends generally laterally across said implement to facilitate locating said dozer blade proximate to said implement frame.

2. The mounting apparatus according to claim 1 wherein said mounting means includes laterally spaced side members extending away from said implement frame for positioning and securing said dozer blade to said implement frame.

3. An apparatus for mounting a laterally extending dozer blade on a fore-and-aft extending implement frame, said implement frame being supported for movement on at least one pair of wheels which rotate about a common axis, said mounting apparatus comprising:

a dozer blade mounting assembly connecting said dozer blade to said implement frame in a manner permitting angular movement of said dozer blade about a generally vertical pivot axis and including laterally spaced arms for connecting said dozer blade to said mounting assembly and for allowing vertical movement of said dozer blade about a generally horizontal axis defined by said mounting assembly;

fluid actuated blade positioning means connected to said mounting assembly for effecting powered vertical movement of said dozer blade about said generally horizontal axis;

a toggle linkage mechanism coupled at opposite ends to said mounting assembly and said implement frame; and linearly distendable driver means connected to said implement frame and having a movable driver end connected to said toggle linkage mechanism between opposite ends thereof for selectively imparting angular movement to said dozer blade, said driver means extending laterally across said implement frame to minimize distance between said dozer blade and the common axis of said wheels while permitting extended angular movement of the dozer blade about said generally vertical axis.

4. The mounting apparatus according to claim 3 wherein said blade mounting assembly is configured to locate the generally vertical axis about which the dozer blade angularly moves forwardly of the generally horizontal axis about which the dozer blade vertically moves to minimize distance between said dozer blade and the common axis of said wheels.

5. The mounting apparatus according to claim 3 wherein one end of said toggle linkage assembly is articulately connected to said mounting assembly at a location rearwardly of the generally vertical axis about which the dozer blade angularly moves.

6. An apparatus for mounting a laterally extending dozer blade at one end of a fore-and-aft extending implement frame, said implement frame being supported for movement on at least one pair of wheels which rotate about a common axis, said mounting apparatus comprising:

a dozer blade mounting assembly attached to said implement frame, said mounting assembly including a mounting frame carried by said implement frame and provided with a pivot pin defining a generally vertical axis about which the dozer blade angularly moves and a C-frame extending in a fore-and-aft relation from and connected to said mounting frame for angular movement about said pivot pin and defining a generally horizontal axis for allowing vertical movement of the dozer blade connected thereto toward a distal end thereof;

fluid operated blade positioning means operatively connected between said C-frame and said dozer blade for effecting powered vertical movement of said dozer blade about said generally horizontal axis;

a linearly distendable driver connected to said mounting frame for imparting angular movement to said dozer blade, said driver extending laterally across and between said mounting frame and said C-frame to minimize fore-and-aft spacing therebetween thereby keeping the dozer blade close to the common axis of the wheels; and toggle linkage means connected at opposite ends to said mounting frame and said C-frame and connected intermediate its ends to said linearly distendable driver for improving angling moments of said dozer blade and enhancing performance of the driver in imparting angular movement to the dozer blade.

7. The mounting apparatus according to claim 6 wherein said C-frame includes laterally spaced side arms which pivot about and extend forwardly from said horizontal axis and are connected at their distal ends to said dozer blade.

8. The mounting apparatus according to claim 6 wherein said toggle linkage means includes linkage articulately connected to said C-frame at a location rearward of the pivot pin defining the generally vertical axis about which the dozer blade angularly moves to minimize fore-and-aft spacing between the mounting and C-frame.

9. The mounting apparatus according to claim 6 further including stop means for limiting angular movement of said dozer blade about said generally vertical axis.

10. An apparatus for mounting a dozer blade on a frame of an implement for angular movement relative to said frame, said mounting apparatus comprising:

mounting means for connecting said dozer blade to said implement frame in a manner permitting angular movement of said dozer blade about a fixed generally vertical axis, driver means operable along a generally linear path of travel between extended and retracted positions for selectively imparting angular movement to said dozer blade, said driver means extending generally laterally across said implement frame to minimize the distance said dozer blade is spaced from said mounting means; and linkage means for connecting said dozer blade to said driver means and for transmitting loads placed on said dozer blade to said driver means, said linkage means including first linkage connected to said implement frame at a first connection and second linkage connected to said mounting means at a second connection, said first and second linkages being connected to each other and to said driver means at a third connection, with said second and third connections being generally aligned with the path of travel of said driver means to maximize the effectiveness of said driver means in moving said dozer blade.

* * * * *